US005611678A

United States Patent [19]

Pascual

[11] Patent Number: 5,611,678

[45] Date of Patent: Mar. 18, 1997

[54] SHAFT SEAL ARRANGEMENT FOR AIR DRIVEN DIAPHRAGM PUMPING SYSTEMS

[75] Inventor: Wilfred D. Pascual, Baldwin Park, Calif.

[73] Assignee: Wilden Pump & Engineering Co., Colton, Calif.

[21] Appl. No.: 425,650

[22] Filed: Apr. 20, 1995

[51] Int. Cl.[6] ..... F04B 17/00; F04B 53/00

[52] U.S. Cl. ..... 417/393; 91/319; 277/165; 137/625.69

[58] Field of Search ..... 417/393, 395; 91/319; 277/165; 137/625.69

[56] References Cited

U.S. PATENT DOCUMENTS

| | | | |
|---|---|---|---|
| 3,071,118 | 1/1963 | Wilden . | |
| 3,636,824 | 1/1972 | Clark | 277/165 |
| 3,770,285 | 11/1973 | Grover | 277/165 |
| 4,247,264 | 1/1981 | Wilden . | |
| 4,406,596 | 9/1983 | Budde | 417/393 |
| 4,793,433 | 12/1988 | Emori et al. | 277/165 |
| 5,169,296 | 12/1992 | Wilden . | |
| 5,222,876 | 6/1993 | Budde | 417/393 |
| 5,362,212 | 11/1994 | Brown et al. | 417/395 |

FOREIGN PATENT DOCUMENTS

| | | | |
|---|---|---|---|
| 3310131 | 9/1984 | Germany | 417/393 |
| 6147129 | 5/1994 | Japan | 417/395 |

*Primary Examiner*—Timothy Thorpe
*Assistant Examiner*—Roland G. McAndrews, Jr.
*Attorney, Agent, or Firm*—Lyon & Lyon

[57] ABSTRACT

An air driven diaphragm pump having two diaphragms joined by a common control shaft to reciprocate in opposed chambers for pumping material through check valve ported cavities. An actuator valve is associated with the central housing of the pump and includes a valve cylinder within which a valve piston reciprocates. The valve piston is caused to reciprocate by alternate venting of the ends of the cylinder. Air chamber passages are controlled by the control shaft to vent the ends of the valve cylinder. A cylindrical portion of the control shaft includes axial slots for venting alternate ends of the valve piston. Annular channels manifold air to and from the axial slots. Seals of elastomeric annular rings and PTFE cylindrical inner liners bonded to the annular rings are arranged in certain of the annular channels, the sidewall of one of which is relieved outwardly for increased venting air flow.

2 Claims, 3 Drawing Sheets

SHAFT SEAL ARRANGEMENT FOR AIR DRIVEN DIAPHRAGM PUMPING SYSTEMS

BACKGROUND OF THE INVENTION

The field of the present invention is control of air driven diaphragm pumps.

Pumps having double diaphragms driven by compressed air directed through an actuator valve are well known. Reference is made to U.S. Pat. No. 5,169,296; U.S. Pat. No. 4,247,264; U.S. Pat. No. Design 294,946; U.S. Pat. No. Design 294,947; and U.S. Pat. No. Design 275,858, all issued to James K. Wilden, the disclosures of which are incorporated herein by reference. An actuator valve operated on a feedback control system is disclosed in U.S. Pat. No. 3,071,118 issued to James K. Wilden, the disclosure of which is also incorporated herein by reference. This feedback control system has been employed with the double diaphragm pumps illustrated in the other patents.

Such pumps include an air chamber housing having a center section and two concave discs facing outwardly from the center section. Opposing the two concave discs are pump chamber housings. The pump chamber housings are coupled with an inlet manifold and an outlet manifold through ball check valves positioned in the inlet passageways and outlet passageways from and to the inlet and outlet manifolds, respectively. Diaphragms extend outwardly to mating surfaces between the concave discs and the pump chamber housings. The diaphragms with the concave discs and with the pump chamber housings each define an air chamber and a pump chamber to either side thereof. At the centers thereof, the diaphragms are fixed to a control shaft which slidably extends through the air chamber housing.

Actuator valves associated with such pumps have included feedback control mechanisms including a valve piston and airways on the control shaft attached to the diaphragms. Air pressure is alternately generated in each air chamber according to control shaft location, driving the diaphragms back and forth. In turn, the pump chambers alternately expand and contract to pump material therethrough. Such pumps are capable of pumping a wide variety of materials of widely varying consistency.

FIG. 1 illustrates a previously designed bushing PA1 to receive a shaft with axial slots cut into the surface which moves axially through the central control passageway of the bushing. The bushing PA1 has four annular channels PA2, PA3, PA4 and PA5 to either side of the center. From the center toward the ends of the bushing, the second and fourth channels PA3 and PA5 of each set of four receive O-rings PA6 to act as annular seals between the bushing PA1 and the shaft in order that flow may be controlled between the central annular channels PA4 and vent channels PA2. The valving mechanism provided by the shaft and the bushing PA1 cooperates with a control valve to alternately vent either end of a shuttle piston at the ends of the stroke of the shaft through the channels PA4. The venting occurs when the axial slots of the shaft span alternately the two channels PA3 containing O-rings PA6 to expose the central annular channels PA4 to the vent channels PA2. This arrangement has long been employed because of the need to rapidly vent the appropriate passage of the control valve.

FIG. 2 also illustrates a previously designed bushing PA7. The bushing PA7 uses the same shaft as the bushing PA1 of FIG. 1 with the axial slots. The bushing PA7 has the same set of annular channels PA2, PA3, PA4 and PA5. The second and fourth channels PA3 and PA5 again contain O-rings PA6 for sealing against the shaft. In addition, slipper seals PA8 of PTFE are positioned in the channels PA3 and PAS. These seals PA8 were independent of the O-rings PA6 and could glide between edges of the channels PA3 and PAS. The bushing PA7 is of plastic and has no relief between the second and third channels PA3 and PA4 which would otherwise be provided through an increased diameter of the passageway through the bushing at that wall. Such a relief is illustrated in the bushing PA1 of FIG. 1 which is a brass design incapable of using the slipper seals PA8. Such a relief would allow the slipper seals PA8 to slide from the channel PA3 in the brass bushing PA1. The design of FIG. 2 is used as a lubrication free design compromising performance by eliminating the relief and reducing the air flow in exchange for the advantages provided by the slipper seals PA8.

SUMMARY OF THE INVENTION

The present invention is directed to an air driven diaphragm pump employing a shaft extending through a bushing to attach a diaphragm. The shaft includes a cylindrical portion having axial slots cooperating with two annular channels to shift a control valve directing air to the pump. Annular seals are positioned in channels adjacent the channels venting the control valve. The annular seals each include an elastomeric annular portion and a PTFE portion attached to the inner periphery of the elastomeric portion, the inside surface of the PTFE portion being in contact with the surface of the shaft to form a seal thereabout. A conventional brass bushing with relief about the shaft may be employed in this combination.

Accordingly, it is an object of the present invention to provide an improved air driven diaphragm pump having accurate shifting capabilities and significant seal longevity.

DETAILED DESCRIPTION OF THE PREFERRED EMBODIMENT

Figure 1:
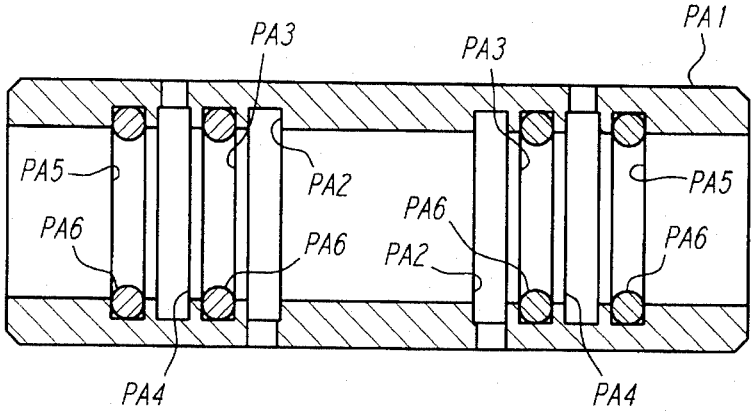
FIG. 1 (PRIOR ART)
FIG. 1 is a cross-sectional view of a prior art bushing.
Figure 2:
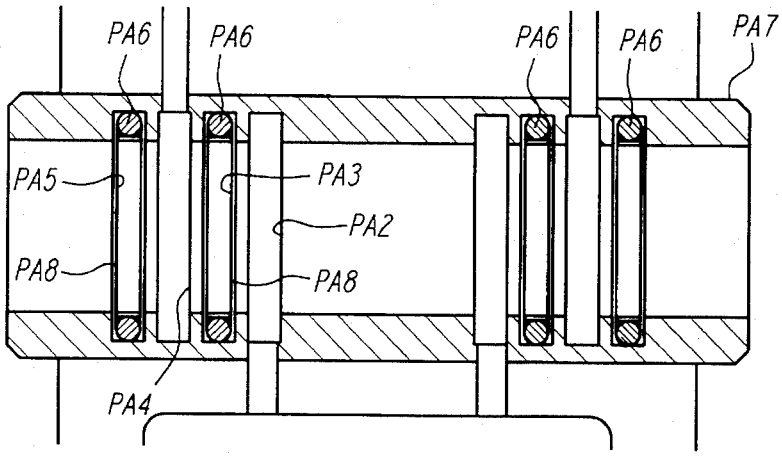
FIG. 2 (PRIOR ART)
FIG. 2 is a cross-sectional view of a second prior art bushing.
Figure 6:
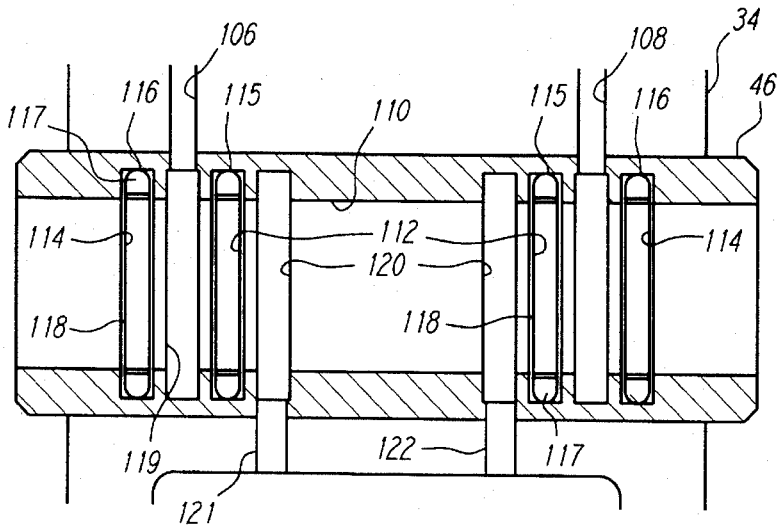
FIG. 6 is a cross-sectional view of a bushing of the present invention.

Turning in detail to the drawings, FIGS. 1, and 2 represent prior art devices. FIGS. 3 through 6 illustrate a preferred embodiment of the present invention. The air driven double diaphragm pump is illustrated in central cross section in FIG. 3 as including two water chamber housings 10 and 12. The water chamber housings 10 and 12 are identical and each includes an inlet passage 14, an outlet passage 16, an inlet ball check valve 18 associated with a valve seat 20 and an outlet ball check valve 22 associated with a valve seat 24. A central cavity 26 is associated with a diaphragm to define a variable volume pump chamber in communication through the valves 18 and 22 with the inlet 14 and outlet 16, respectively. Associated with the two inlets 14 of the water chamber housings 10 and 12 is an inlet Tee 28 having an internally threaded inlet port 30 for receipt of a suction hose or the like. Similarly arranged with the outlet passages 16 is an outlet Tee 32 which includes a similar port 34 for coupling with a discharge hose or the like.

Centrally located between the water chamber housings 10 and 12 is an actuator housing, generally designated 34. The actuator housing integrally includes a control shaft housing 36 located between air chamber members 38 and 40. The air chamber members 38 and 40 each define variable volume air chambers 42 and 44 with an associated diaphragm. The center section forming the control shaft housing 36 includes a hole extending therethrough to receive a bushing 46.

Extending through the bushing 46 is a control passageway 48 which receives a control shaft 50. The control shaft 50 has an axial passage, discussed in greater detail below, centrally located therein. At its outer ends, the control shaft 50 includes threaded end portions for the receipt of identical locking bolts 54 which hold mounting flanges 56 and 58 in position. Between the mounting flanges 56 and 58 at each end of the control shaft 50 are mounted flexible diaphragms 60. One such diaphragm is illustrated in U.S. Pat. No. 4,238,992 to Tuck, Jr., the disclosure of which is incorporated herein by reference. About the outer periphery of each of the flexible diaphragms 60 is a circular bead 62. The circular bead 62 is positioned in circular recesses located on each of the water chamber housings 10 and 12 and the air chamber members 38 and 40 of the actuator housing 34. Clamp bands 64 retain the diaphragms 60, the water chamber housings 10 and 12 and the actuator housing 34 in assembly.

The air driven double diaphragm pump is driven by pressurized air alternately being charged to and vented from each of the variable volume air chambers 42 and 44. Assuming the operating condition that the control shaft 50 is moving to the left in FIG. 3, the air chamber 42 would be in communication with the source of pressurized air while the air chamber 44 would be venting to atmosphere. This differential pressure operating on the diaphragms 60 forces the diaphragms 60 and in turn the control shaft 50 to move to the left. In doing so, the central cavity 26 in the water chamber housing 10 is being reduced by the displacement of the left diaphragm 60. At the same time, the central cavity 26 associated with the water chamber housing 12 is expanding. Thus, the water chamber housing 10 is experiencing an exhaust stroke while the water chamber housing 12 is experiencing a suction stroke. In the suction stroke, the ball valve 18 admits material to be pumped from the inlet passage 14. At the same time, the outlet ball valve 22 is seated to insure proper suction. In the exhaust stroke, the ball valve 18 is seated while the ball valve 22 is lifted for discharge of material within the central cavity 26. Through continued reciprocation of the diaphragms 60 and the control shaft 50, the two central chambers 26 alternately draw material to be pumped into the chamber and exhaust same. This type of pump has the capacity for pumping a wide variety of materials of widely varying viscosities and amounts of entrained solids.

To provide the alternating pressurized air and venting to the pump, an actuator valve is employed. The actuator valve is defined within an actuator housing which includes a valve housing 66 and the actuator housing 34. The valve housing 66 includes a generally cylindrical body having a mounting flange 68. The housing 66 is securely fastened to the front wall of the actuator housing 34 by fasteners. The housing 66 includes a valve cylinder 72. The valve cylinder is closed at each end by plugs 74 and 76 retained by spring clip 78. The spring clips 78 are set within grooves designed for this purpose. The plugs 74 and 76 include sealing O-rings positioned in peripheral grooves about each plug. An inlet 80 extends to the center of the valve cylinder 72 and is internally threaded for receipt of a shop air hose or the like. One of the plugs 76 includes a pin 82 extending into the main portion of the valve cylinder 72 for alignment purposes.

Located within the valve cylinder 72 is a valve piston 84. The valve piston 84 is arranged to slide within the cylinder 72 such that the piston 84 is capable of stroking back and forth from end to end within the cylinder. The piston 84 includes spacers 86 on either end thereof. These spacers 86 each define an annular cavity between the end of the piston 84 abutting against a plug 74, 76. The body of the valve piston 84 is sized such that clearance is provided between the wall of the cylinder 72 and the valve piston 84 to provide means for continuously directing air to the ends of the cylinder. The clearance is such that this flow of air axially between the piston 84 and the wall of the cylinder 72 is restricted. Pressure is accumulated over a short period of time prior to the next piston stroke but cannot flow so quickly as to prevent substantial venting of the cylinder at one or the other of the ends of the piston 84.

Longitudinal passages 88 extend from the near midpoint of the piston 84 to either end. Associated with these longitudinal passages 88 are pinholes 90 such that a volume of incoming air through the inlet 80 may be directed through one or the other of the pinholes 90 and the associated passage 88 to an end of the cylinder 72. Thus, only one of the pinholes 90 is ever exposed to the inlet 80 at a time such that incoming air is able to flow through only one of the pinholes 90 at a time when positioned in communication with the inlet 80 during a portion of the stroke. This arrangement enhances shifting as will be discussed below. Conveniently, the pin 82 is sized and positioned within one of the longitudinal passages 88 to allow free air flow thereabout.

Located in an annular groove about the center of the valve piston 84 is an inlet passage 92. The width of the inlet 80 at the cylinder 72 is such that the inlet passage 92 is always exposed to the inlet. Thus, a constant source of air is provided to a location diametrically opposed to the inlet 80 across the piston 84. Located on the side of the piston 84 on the other side from the inlet 80 are two valve passages 94 and 96. These valve passages 94 and 96 extend axially along the piston 84 and are mutually spaced to either side of the inlet passage 92. In the preferred embodiment, these valve passages 94 and 96 are channels.

Defined within the cylinder 72 diametrically across from the air inlet 80 are two air chamber passages 98 and 100 and two exhaust ports 102 and 104. The air chamber passages 98 and 100 and the exhaust ports 102 and 104 extend through the valve housing 66 and through the actuator housing 34. The air chamber passages 98 and 100, the exhaust ports 102 and 104 and the end of the inlet passage 92 are axially aligned along the cylinder 72. The longitudinal passages 94 and 96 are able to selectively span across from one air chamber passage 98, 100 to an exhaust port 102, 104. Further, the air chamber passages 98 and 100 are arranged such that the inlet passage 92 is aligned with one or the other of these with the valve piston 84 located at one or the other of the ends of its stroke. Thus, at one end of the stroke of the piston 84, the inlet passage 92 is in communication with the air chamber passage 98 and the valve passage 96 is in communication at its ends with the air chamber passage 100 and the exhaust port 104. The valve passage 94 is in communication with the exhaust port 102 to no effect. The air chamber passages 98 and 100 each extend to one of the variable volume air chambers 42 and 44. Consequently, one air chamber is pressurized by being in communication with the inlet passage 92 through the air chamber passage 98 while the other air chamber is exhausted through the air chamber passage 100, the valve passage 96 and the exhaust port 104. By shifting the valve 84, the process is reversed.

Extending from adjacent each end of the valve chamber 72, shift passages 106 and 108 are arranged for controlling the valve piston 84. These shift passages 106 and 108 extend through the valve housing 66 and the actuator housing 34. Each shift passage 106 and 108 is defined by two passageways which are mutually displaced one from another in the valve housing 66 and are located adjacent an end of the valve cylinder 72 at the plugs 74 and 76. The passageways of the shift passages 106 and 108 are joined in the control shaft housing 36.

The bushing 46 includes four annular channels about the control passageway 48 to either side of a central bearing surface 110. In each set of four annular channels, there are two sealing channels 112 and 114 which retain annular seals 115 and 116, respectively, to form a controlled area about the control shaft 50 therebetween. Each annular seal 115 and 116 includes two portions, an elastomeric ring 117 and a PTFE cylinder 118. The PTFE cylinders 118 are bonded to the elastomeric rings 117. The elastomeric rings 117 are rounded about their outer periphery to aid in positioning and to provide some relief for resilient movement. The sidewalls of each annular seal 115 and 116 retain the elastomeric ring 117 and the PTFE cylinder 118 positioned within the channels 112 and 114. This composite construction of the annular seals 115 and 116 provides for a low friction sliding seal against the shaft 50 and a resilient response of the overall device. The annular seals 115 and 116 are commercially available.

Between the two sealing channels 112 and 114 on either end of the bushing 46, annular channels 119 communicate with shift passages 106 and 108, respectively. Inwardly of the sealing channels 112 is an annular channel 120 on either end of the central bearing 110 surface of the bushing 46. These annular channels 120 are in communication with vent passages 121 and 122 which vent to atmosphere. Thus, when communication is created between either one of the annular channels 119 and an annular channel 120, a shift chamber at either end of the piston 84 is vented to shift the piston to the other end of the valve cylinder 72. This shifting occurs because of the differential pressure between the vented end and the unvented end of the piston 84 where pressure has accumulated. To enhance the shifting, relief is provided in the wall of the bushing 46 between the channels 112 and 119. This relief is provided by increasing the diameter of the passageway 48 at this point. A greater cross-sectional area for air to pass from the channel 119 to the channel 120 is provided when the seal is bridged by the axial slots 124 with this relief.

To provide communication selectively between sets of annular channels 119 and 120 for shifting the piston 84, the control shaft 50 includes a central cylindrical portion having axial slots 124. The axial slots 124 are mutually angularly spaced apart and are located at a common axial position along the control shaft 50 and are also of common extent such that they act uniformly across the seal in annular channel 114, and connect the two shifting channels 119 and 120. Any number of such slots 124 may be provided and are most appropriately equiangularly placed. The central cylindrical portion of the control shaft 50 is fully cylindrical, including between axial slots 124. The axial slots 124 do not extend axially for the full axial length of the cylindrical portion of the control shaft 50. This provides a uniform cylindrical surface upon which the annular seals, defined by the seals 115 and 116, slide. By having the axial slots 124 associate with both an annular channel 119 to manifold venting air to the slots and the annular channel 120 to manifold air from the slots 124 to atmosphere, sufficient air flow ms achieved to allow shifting of the piston 84 without substantial resistance. Free shifting is helpful to avoid the possibility of stalling the piston 84 between positions. The cylindrical nature of the central portion of the control shaft 50 provides for seal longevity. The function of the central portion with the axial slots 124 in controlling communication of both sets of slots may alternatively be provided by two such central portions, each with axial slots 124, with each portion being excessively associated with one set of annular channels, respectively.

Figure 3:
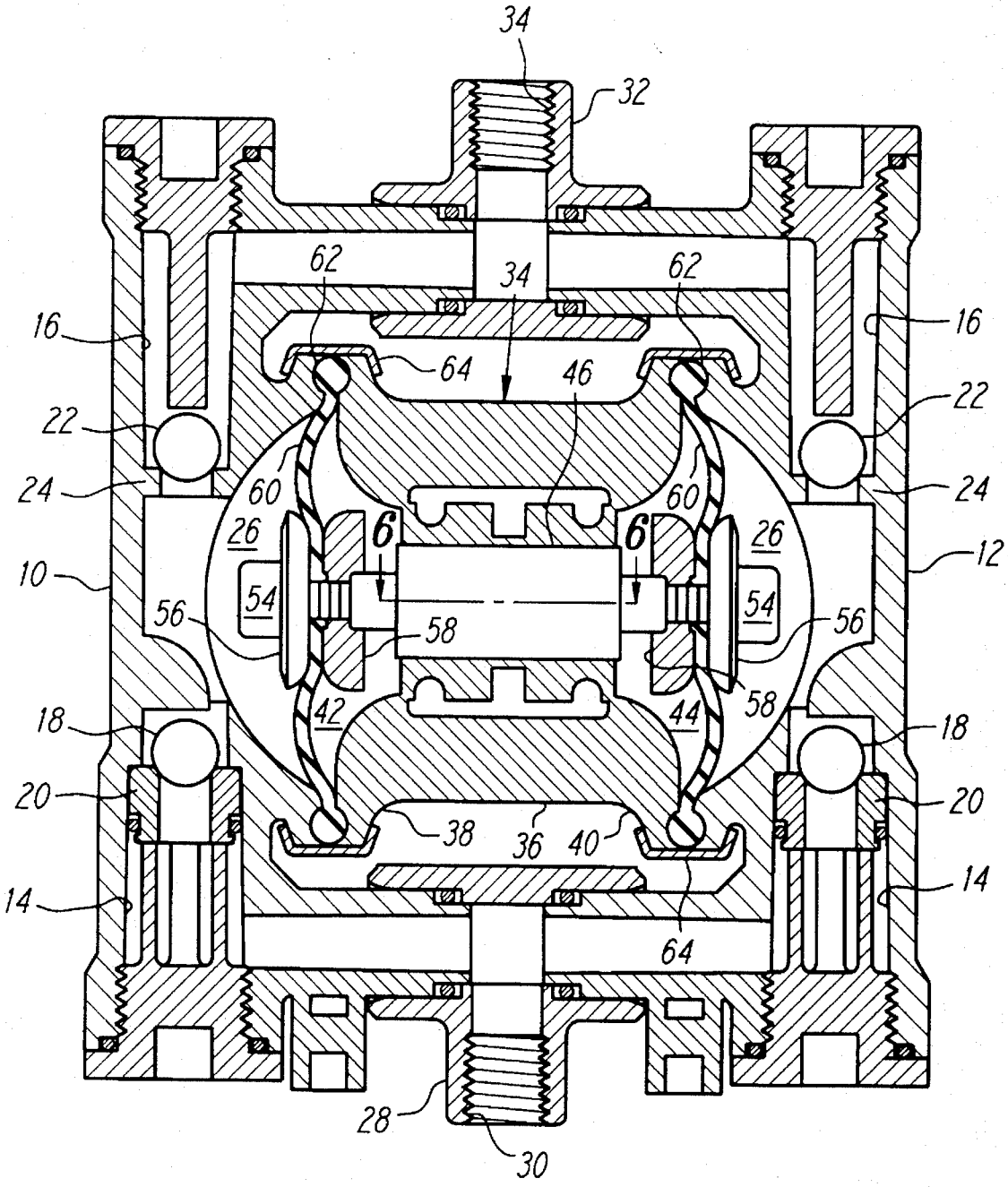
FIG. 3 is a cross-sectional view of an air driven diaphragm pump incorporating the present invention.
Figure 4:
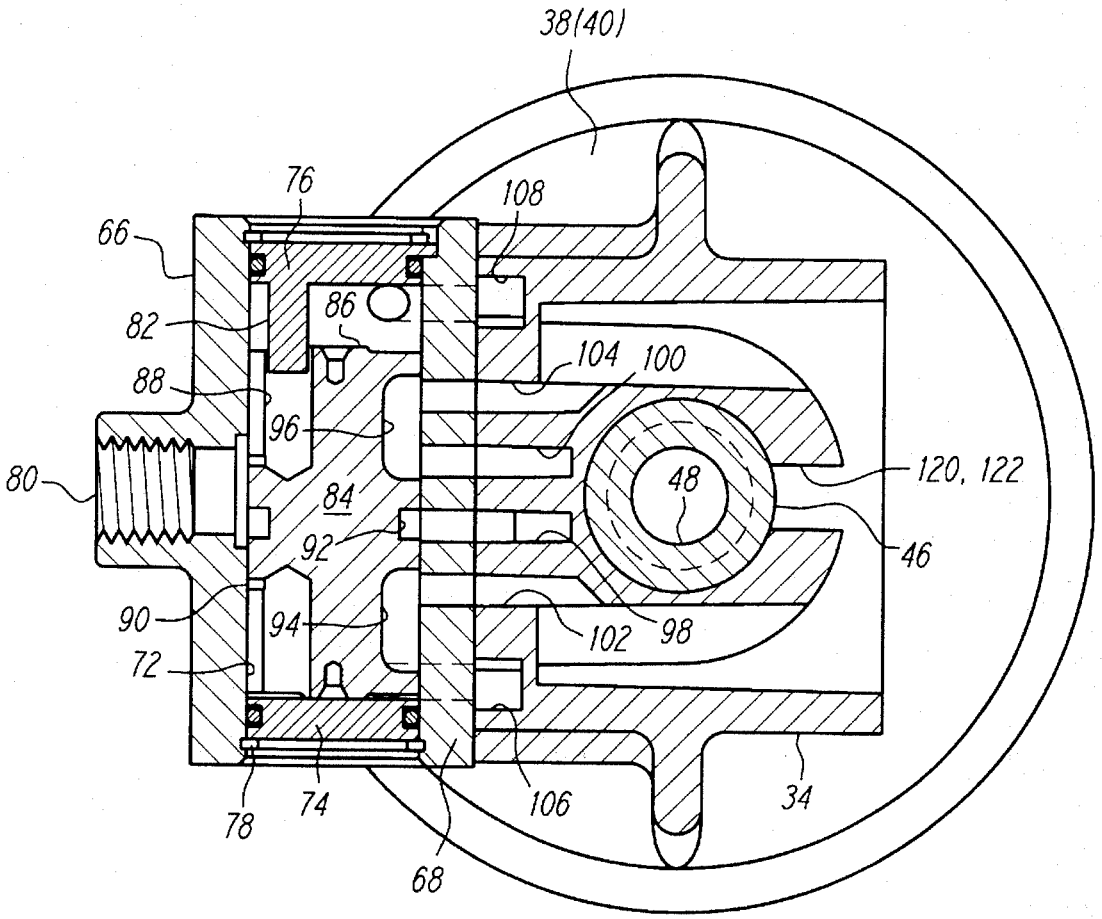
FIG. 4 is a cross-sectional view of an actuator valve associated with the air driven diaphragm pump.
Figure 5:
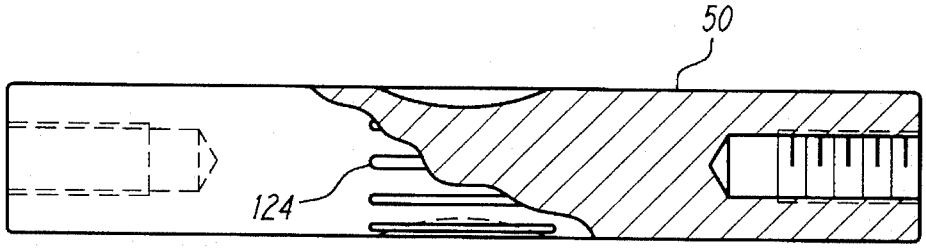
FIG. 5 is a side view, partially in cross section of a shaft used with the air driven diaphragm pump.

In operation, pressurized air is provided to the inlet 80. Normally the valve piston 84 is found in its lower position due to gravity prior to activation of the pump. Such a position of starting is illustrated in FIG. 4. Both ends of the valve cylinder 72 are pressurized, either through the passageways or through the tolerance about the valve piston 84. Pressurized air is also conveyed through the inlet passage 92 to the air chamber passage 98. Air is directed through the passage 98 to the variable volume chamber 44 to force the diaphragm 60 further into the central cavity 26 to the right as seen in FIG. 3. Thus, pumping action is initiated with a pressure stroke on the right and a suction stroke on the left as seen in FIG. 3. When the control shaft 50 advances to the point that the axial slots 124 span the seal 115, the shift passage 108 communicates with the vent through passage 122. Once such communication is established, the cavity at the upper end of the valve cylinder 72 is vented and the compressed air at the other end of the valve cylinder 72 drives the piston 84 upwardly to the other end of its stroke. Venting through the shift passage 108 must exceed the flow through the upper pinhole 90 and the flow around the piston 84 through the clearance with the cylinder 72. In this way, pressure is reduced at the upper end of the cylinder and the pressure remaining at the closed end of the cylinder is able to force the piston through its stroke. Once it reaches just past midstroke, the lower pinhole 90 further contributes air to the lower, closed end of the valve cylinder 72. Once shifted, air to and from the double diaphragm pump is reversed. Incoming air now is directed through the inlet passage 92 to the air chamber passage 100 which is directed to the variable volume air chamber 42 on the left side of the pump as illustrated in FIG. 3. Thus, the left central cavity experiences a pressure stroke while the right central cavity experiences a vacuum stroke. Eventually the control shaft 50 proceeds such that the axial slots 124 span the seal 115 and the cycle is then repeated. Venting of the ends of the valve chamber are enhanced with increased flow for shifting.

Accordingly, an improved feedback control system for actuating an air driven diaphragm pump is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An air driven diaphragm pump comprising a diaphragm;

a bushing having a passageway therethrough and annular channels within the passageway;

a control valve;

a passage between the valve and a first of the channels;

a vent passage extending from a second of the channels to atmosphere;

a shaft fixed to the diaphragm and including a cylindrical portion slidably extending through the passageway, extending across and longitudinally outwardly of the first and second channels throughout the full stroke of the diaphragm and having axial slots mutually angularly spaced, of mutually common axial placement and extent and selectively extending between the first and second channels;

annular seals in a third and a fourth of the channels, the third and fourth channels being to either side of the first channel with the fourth channel being between the first and second channels, the annular seals each including an elastomeric annular portion and a PTFE cylindrical portion attached to the inner periphery of the elastomeric annular portion fully about the outside cylindrical surface of the PTFE cylindrical portion, the inside cylindrical surface of the PTFE cylindrical portion being in contact with the surface of the shaft to form a seal thereabout, the passageway in the bushing having a larger diameter between the first and fourth channels to provide relief between the shaft and the bushing between the first and fourth channels.

2. An air driven diaphragm pump comprising a diaphragm;

a bushing having a passageway therethrough and two sets of annular channels within the passageway;

a control valve;

first and second passages between the valve and a first channel of each set of channels, respectively;

a vent passage extending from a second channel of each set of channels to atmosphere;

a shaft fixed to the diaphragm and including a cylindrical portion slidably extending through the passageway, extending across and longitudinally outwardly of the first and second channels of each set of channels throughout the full stroke of the diaphragm and having axial slots mutually angularly spaced, of mutually common axial placement and extent less than the full axial extent of the cylindrical portion and selectively extending between the first and second channels of each set of channels, respectively;

annular seals in a third channel and a fourth channel of each set of channels, the third and fourth channels of each set of channels being to either side of the first channel of each set of channels, respectively, with the fourth channel of each set of channels being between the first and second channels of each set of channels, respectively, the annular seals each including an elastomeric annular portion and a PTFE cylindrical portion attached to the inner periphery of the elastomeric annular portion fully about the outside cylindrical surface of the PTFE cylindrical portion, the inside cylindrical surface of the PTFE cylindrical portion being in contact with the surface of the shaft to form a seal thereabout, the passageway in the bushing having a larger diameter between the first and fourth channels of each set of channels to provide relief between the shaft and the bushing between the first and fourth channels of each set of channels.

* * * * *